United States Patent [19]

Lin

[11] Patent Number: 5,074,607

[45] Date of Patent: Dec. 24, 1991

[54] LOCK SET WITH SPINDLE LOCK

[76] Inventor: Jui C. Lin, No. 55-10, Been Chou Rd., Kangshan, Kaohsiung Hsien, Taiwan

[21] Appl. No.: 577,771

[22] Filed: Sep. 5, 1990

[51] Int. Cl.[5] ..... E05C 1/16

[52] U.S. Cl. ..... 292/359; 292/DIG. 27

[58] Field of Search ..... 292/359, DIG. 27

[56] References Cited

U.S. PATENT DOCUMENTS

| | | | |
|---|---|---|---|
| 2,602,318 | 7/1952 | Belausleguigartia | 292/359 X |
| 3,800,573 | 4/1974 | Babb, Jr. et al. | 292/359 X |
| 3,823,585 | 7/1974 | Spon | 292/359 X |

*Primary Examiner*—Richard E. Moore

*Attorney, Agent, or Firm*—Fleit, Jacobson, Cohn, Price, Holman & Stern

[57] ABSTRACT

A cylindrical lock is locked, the "locked" position is kept from the outside knob, which can not be revolved to open the door, but the inside knob is turnable to open the door after the lock is locked.

2 Claims, 3 Drawing Sheets

LOCK SET WITH SPINDLE LOCK

BACKGROUND OF THE INVENTION

This invention relates to a structure of a cylindrical lock. According to the U.S. patent application Ser. No. 07/340,753, entitled "Lock Set with Spindle Lock", it relates to the structure of a tubular lock. Both the inside and outside knobs are locked simultaneously and not turnable after the lock is locked. Therefore, the inside and outside knobs cannot be turned to unlock the lock after the lock is locked. To open the door, the turning button of the inside knob has to turn back or a suitable key must be inserted to turn the turning button of the outside knob. Then the inside knob and the outside knob will be turnable. A trumpet lock, which can be unlocked by turning the inside knob from the inside of a door, is better than a tubular lock. Hence it will be pitiful for time delay or the ignorance of the child in some emergency situations.

SUMMARY OF THE INVENTION

The object of this invention is to provide a tubular lock. Locking the inside knob will control only the outside knob not to turn, but the inside knob can be turned in any situation to pull the dead bolt inward for opening the door.

A structure of a cylindrical lock is as follows. A handle of the outside knob combines with a moving tube which has two placing notches to stick with the juts of the cap and the fixing plate moving straight. A right key inserts into the lock block of the outside knob to turn a turning button, or from the inside knob using the moving rod revolves the turning button, the cone of the cap will contact with the valley of the turning button. Then the juts of the fixing plate and the cap stick in the placing notches of the outside knob cap so that the outside knob is not turnable. At this moment the fixing plate and the square shaft are separated to make the inside knob turnable and to make the square shaft pull the dead bolt inward.

DETAILED DESCRIPTION OF THE INVENTION

Figure 1:
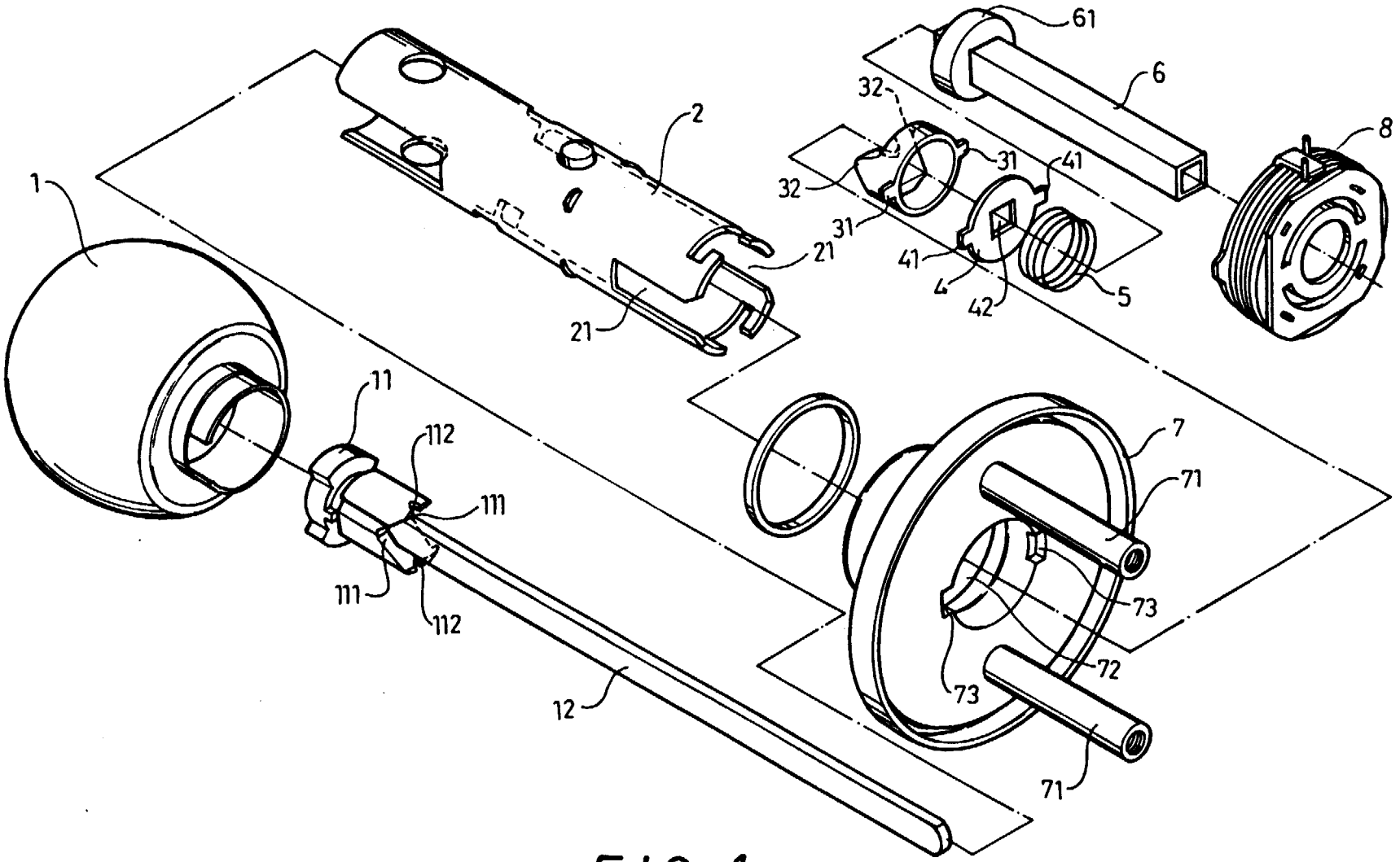
FIG. 1 is an exploded perspective view of this invention.

First, referring to FIG. 1, the present invention improves only the part of the outside knob of a tubular lock. Hence this invention only describes the structure of the outside knob.

The outside knob comprises a globe handle 1, which includes a lock block (not shown) to insert a suitable key and to turn a turning button 11. The turning button 11 combines with a long flat moving rod 12. The one end of the moving rod 12 inserts into the inside knob to combine with the turning button of the inside knob so that the moving rod can be turned for 90° from the unlocked position to the locked position either the turning button of the inside knob is turned or the lock barrel of the outside knob is turned by the key. This is the conventional structure.

A handle 1 uses a neck tube to combine with a moving tube 2 and both turn together. The moving tube 2 can be turned if the handle 1 turns. The turning button 11 and the moving rod 12 are set inside the moving tube 2. There are two straight flutes 21 in the one end of the moving tube 2. The straight flutes 21 are provided to receive two juts 31 of the cap 3. The cap 3 located behind the moving tube 2 only can move along the straight flutes 21. A cone 32 located at one end surface of the cap 3 is provided to contact with the valley 111 of or the top dent 112 of the turning button 11. Turning the turning button 11 can press the cap 3 moving along the straight flutes 21 of the moving tube 2.

Normally, a spring 5 pushes a cap 3 and fixing plate 4 to the end of the straight flutes 21 so that the cone 32 of the cap 3 contacts the valley 111 of or the top dent 112 of the turning button 11.

Two lugs 41 of the fixing plate 4 are received in the straight flutes 21 of the moving tube 2. A square shaft hole 42 provided to engage with a square shaft 6 is at the center of the fixing plate 4.

The square shaft 6 is provided to drive the dead bolt of the lock. The moving rod 12 can insert through the square tube of the square shaft 6. The one side of spring 5 pushes a cap ring 61 of the square shaft 6. The other end of spring 5 pushes the fixing plate 4 so as to separate the fixing plate 4 and the square shaft 6. The one end of the square shaft 6 engages with the turning button of the inside knob in order that the turning button of the inside knob can revolve the square shaft 6.

The outside cover 7 is to be fixed on a door with screws, provided with two screw posts 71 for screw bolts to pass through the inside knob, and a shaft hole 72 for the moving tube 2 to fit therein. The moving tube 2 and the handle 1 can not separate from outside if they combine together. The one end of the moving tube 2 combines with a reset spring base 8 to reset the handle 1 after turning. Two placing notches 73 are symmetrically located at the left and right edges of the shaft hole 72 for separating or sticking with the juts 31 of the cap 3 and the juts 41 of the fixing plate 4.

Figure 2:
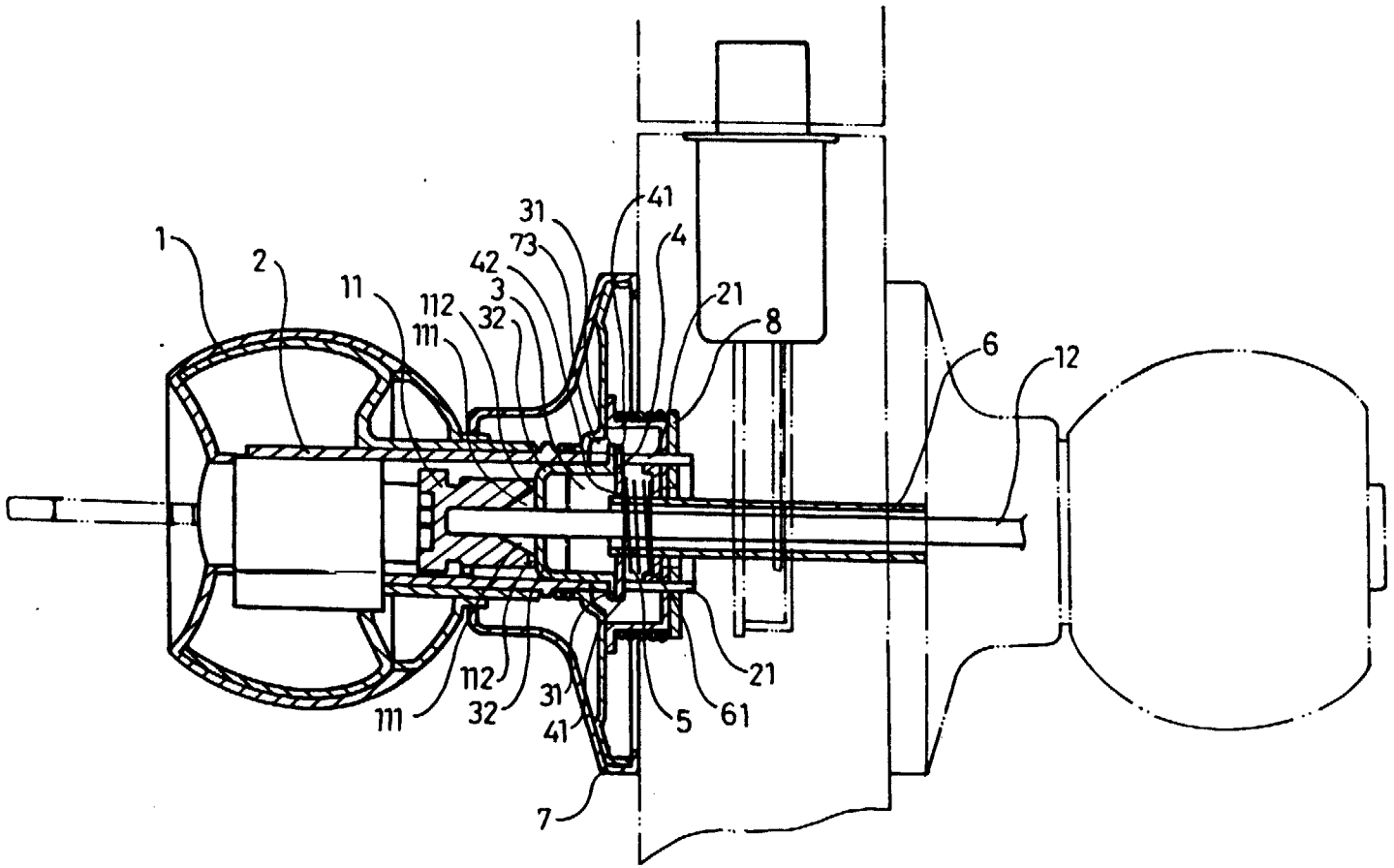
FIG. 2 is a cross-sectional view of this invention in the position of "unlocked" position.

Second, referring to FIG. 2, the inside and outside handles can be turned freely with the square shaft 6 to pull the dead bolt inward before a right key is inserted into the outside knob or the inside knob revolves the turning button. At this moment, the cone 32 of the cap 3 contacts with the top dent 112 of the turning button 11 when the spring 5 is pressed, the juts 31 of the cap 3 and the juts 41 of the moving plate 4 leave the placing notches 73 of the outside cover 7, the square shaft hole 42 of the moving plate 4 engages with the square shaft 6.

Figure 3:
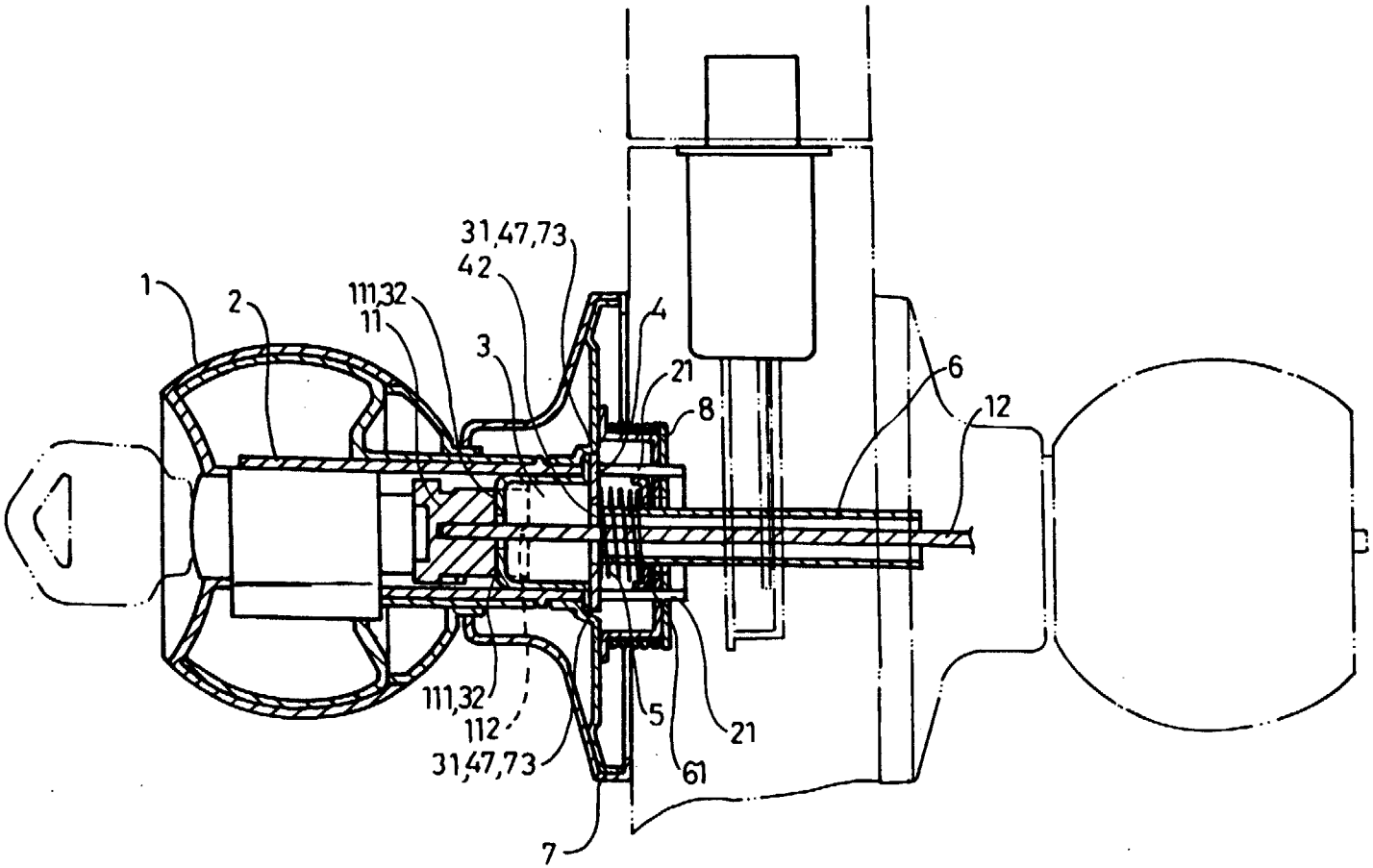
FIG. 3 is a cross-sectional view of this invention in the position of "locked" position.

Third, referring to FIG. 3, if a key is inserted to turn the lock block of the outside knob or the turning button of the inside knob is turned, the turning button 11 and the moving rod 12 are revolved for 90°. The fixing plate 4 and the cap 3 are pushed by the spring 5. The cone 32 of the cap 3 engages in the valley 111 of the turning button 11. Then the juts 31 of the cap 3 and the juts 41 of the fixing plate 4 engage in the placing notches 73 of the outside cover 7. At this moment the square shaft hole 42 and the square shaft 6 are separated. Turning the outside handle 1 can not revolve the turning tube 2 because the juts 31 and 41 stick in the placing notches 73. The outside handle 1 is locked and not turnable. It is useless to turn the outside handle 1 because the fixing plate 4 and the square shaft 6 are separated. Hence the dead bolt can not be pulled from outside, but from inside, i.e., turning the inside knob still can revolve the square shaft 6. The inside handle pulling the dead bolt to unlock is not limited to the door locked.

A feature of this invention is the design of the fixing plate 4. When the lock is unlocked, the fixing plate 4 can engage with the square shaft 6. Hence turning the outside handle revolves the moving tube 2 to drive the fixing plate 4, then the fixing plate 4 revolves the square shaft 6 so that the dead bolt is pulled to the "open" position. When the lock is locked, the fixing plate 4 and the moving rod 6 are separated. The juts 31 of the cap 3 and the juts 41 of the fixing plate 4 together engage with the placing notches 73 of the outside cover 7 so that the square shaft 6 can be revolved by the inside handle to pull the dead bolt. But turning the outside handle is constrained to turn because the cap 3 and the fixing plate 4 are not turnable. Specifically, because the fixing plate 4 and the square shaft 6 are separated, forcing to turn the outside handle 1 is useless so that the square shaft 6 is still not revolved by turning the outside handle.

The structure of this invention brings about that the door locked from inside only blocks the operation from outside, but turning the inside knob can open the door freely.

What is claimed is:

1. The structure of inside and outside knobs of a tubular lock comprising;

an outside knob having an outside handle to combine with a moving tube, which has two straight flutes, said straight flutes being provided to receive juts of a cap and a fixing plate moving along said straight flutes, said moving tube containing a first turning button which combines with one end of a moving rod, the other end of said moving rod combining with a turning button of an inside knob, said first turning button having dents in a valley and top of the button to engage with a cone of said cap selectively, said juts of said cap and said fixing plate, which is pushed by a spring, engaging in said straight flutes of said moving tube, the other end of the spring pushing a cap ring of said square shaft so that said cap and said fixing plate locate on the bottom of said straight flutes, said fixing plate having a square shaft hole to engage and separate with the one of said square shaft, said square shaft passing through the dead bolt and using one end to combine with the inside knob, said outside knob being combined with a shaft hole of an outside cover, two placing notches setting around the shaft hole; turning said turning button of an inside knob or inserting a key into the lock block of an outside knob to turn said turning button revolving said moving rod for 90°, said cone of said cap engaging in the valley of said turning button which is revolved, said juts of said fixing plate and said cap engaging in two placing notches of said outside cover and said square shaft hole of said fixing plate separating with said square shaft when said fixing plate is pressed by the spring; said juts of said fixing plate and said cap leaving said placing notches of the outside cover and said fixing plate engaging with said square shaft when turning said turning button makes said cone of said cap contact the top dent of said turning button.

2. The structure of the inside and outside knobs of a tubular lock as claimed in claim 1, wherein said fixing plate provides two juts to stick in said straight flutes of said moving tube and a square shaft hole to bite with said square shaft.

* * * * *